US005791068A

United States Patent [19]

Bernier et al.

[11] Patent Number: 5,791,068

[45] Date of Patent: Aug. 11, 1998

[54] SELF-TIGHTENING SHOE

[76] Inventors: Rejeanne M. Bernier; Hans S. Croteau, both of 6792 Maury Dr., San Diego, Calif. 92119

[21] Appl. No.: 277,235

[22] Filed: Jul. 19, 1994

Related U.S. Application Data

[63] Continuation-in-part of Ser. No. 189,993, Jan. 31, 1994, abandoned, which is a continuation of Ser. No. 914,740, Jul. 20, 1992, abandoned.

[51] Int. Cl.[6] ..... A43C 11/12

[52] U.S. Cl. ..... 36/50.1; 36/58.5; 40/636

[58] Field of Search ..... 36/1, 136, 139, 36/50.1, 51, 50.5, 117–121, 138, 58.5; 40/636, 633; 2/244, 245, 246

[56] References Cited

U.S. PATENT DOCUMENTS

| | | | |
|---|---|---|---|
| 384,155 | 6/1888 | Hathorn . | |
| 913,012 | 2/1909 | Jackson | 36/51 |
| 1,211,127 | 1/1917 | Fox | 36/51 |
| 1,497,568 | 6/1924 | Kelley | 36/51 |
| 1,640,104 | 5/1927 | Ballou et al. . | |
| 2,557,663 | 6/1951 | Knode . | |
| 2,575,226 | 11/1951 | McHarry | 36/51 |
| 4,043,241 | 8/1977 | Liu . | |
| 4,079,527 | 3/1978 | Antonious . | |
| 4,449,273 | 5/1984 | Baggio . | |
| 4,536,975 | 8/1985 | Harrell . | |
| 4,597,197 | 7/1986 | Strasinger . | |
| 4,712,316 | 12/1987 | Baggio . | |
| 4,733,439 | 3/1988 | Gentry . | |
| 4,735,004 | 4/1988 | Dodge . | |
| 4,771,556 | 9/1988 | Kim . | |
| 4,811,500 | 3/1989 | Maccano . | |
| 4,897,947 | 2/1990 | Kass-Pious . | |
| 4,958,459 | 9/1990 | Davidson . | |
| 5,003,640 | 4/1991 | Pizzacar . | |
| 5,092,067 | 3/1992 | Prout . | |
| 5,159,768 | 11/1992 | Longo, Jr. . | |
| 5,205,055 | 4/1993 | Harrell . | |

FOREIGN PATENT DOCUMENTS

| | | |
|---|---|---|
| 0335467 | 10/1989 | European Pat. Off. . |
| 0644373 | 4/1937 | Germany . |
| 0043905 | 3/1916 | Sweden . |
| 1347424 | 5/1972 | United Kingdom . |

*Primary Examiner*—Ted Kavanaugh

[57] ABSTRACT

The shoe incorporates adjustable straps that are positioned to tighten the shoe casing around a wearer's instep. A retractor mechanism incorporates elastic members. The elastic members are charged when the wearer loosens shoe by pulling on the straps. The stored energy is released when a catch is released releasing the elastic members to tighten and cinch the shoe on the wearer's foot. During charging a first elastic member is extended an intermediate distance and a second elastic member is charged a greater distance. The second elastic member triggers the release of the first elastic member when it reaches the intermediate position, increasing the tension available for cinching the straps.

18 Claims, 4 Drawing Sheets

SELF-TIGHTENING SHOE

CROSS-REFERENCES TO RELATED APPLICATIONS

This application is a Continuation-In-Part of application Ser. No. 08/189,993 filed Jan. 31, 1994, which is a Continuation of application Ser. No. 07/914,740 filed Jul. 20, 1992, now both abandoned.

BACKGROUND OF THE INVENTION

This invention relates in general to shoes that are tightened about a foot by straps, e.g. cinch straps crossing over the instep of a foot, and in particular to such shoes having apparatus for automatically tightening the straps.

Some prior art shoes use Velcro™ straps as tightening means and others have included belts with buckles. Others have proposed complex mechanisms that would not stand up to hard service, or which require an expendable power source (such as an air cylinder).

Tying shoes using conventional laces is tedious, and tied laces have a propensity to become untied. At best, this is a nuisance to many people. It can present a serious problem to handicapped people who either have difficulty bending over, or whose hands are partially disabled from arthritis or some other cause. People having these handicaps naturally tend toward loafer-type shoes that are pulled onto the feet, or into which the feet can be slipped into without using the hands at all. Unfortunately, shoes of this type are never capable of providing the high-level foot support that a good athletic shoe can provide. There is a need, therefore, for a shoe that provides the complete support that a sophisticated athletic shoe, such as a cross-trainer, can provide, but at the same time is so simple to tighten and loosen that even handicapped persons can put their shoes on and take them off without difficulty.

Other advantages and attributes of this invention will be readily discernible upon a reading of the text hereinafter.

SUMMARY OF THE INVENTION

An advantage of this invention is that it allows handicapped persons who have difficulty in putting on and taking off their own laced shoes to readily use shoes with good upper level support.

A further advantage of this invention is that it provides a shoe having an integral apparatus for automatically tightening the shoe about a foot of a wearer without requiring an expendable power source.

Another advantage of this invention is that it provides a shoe with an integral apparatus which can be easily released to loosen the shoe about the foot of the wearer.

These advantages, and others expressed or implicitly revealed in the specification herein, are accomplished by the exemplary embodiments of a self-tightening shoe having at least: a casing for encasing at least a portion of a foot; one or more adjustable straps for cinching the casing to a foot disposed therein; an elastic mechanism for applying tensile force to the strap(s) for cinching the casing whenever the elastic mechanism is released from the charged state; the strap(s) being in a relaxed, i.e., uncinched, loose state for insertion or removal of a foot whenever the elastic mechanism is held in the charged state; a charging mechanism for forcing the elastic mechanism into its charged state; and a releasable catch for constraining the elastic mechanism in its charged state. Preferably the casing has an instep opening to insert and remove a foot and the strap(s) operate to reduce the size of the instep opening. Disclosed herein are two embodiments of an elastic mechanism that can each be called a "retractor" because they operate to pull back, i.e., retract straps to cinch the shoe about a foot. The retractors are each driven by dual elastic members that are connected by strap cables or other flexible non-elastic members to ends of respective straps so that when the elastic members contract, the straps are pulled down tightly along the instep of the foot to secure the shoe about as tightly as if manually secured by laces. Removal of the foot from the shoe is accomplished by pulling up on a top strap which charges, i.e., stretches the elastic members in the retractor until they are engaged by a catch. The elastic members are held in the stretched position until released by pulling a finger grip conveniently located, such as at the top of the shoe. The grip is connected (by a cable in the exemplary embodiment) which, when pulled, disengages the catch, releasing the elastic members to tension the strap cables and thereby the straps. The retractor exerts high tightening force toward the end of its retraction, which is the reverse of a normal elastic member power curve in which the tensioning level increases as a function of the length to which the elastic member is stretched. This results in a quick retraction of a substantial length of the straps and then an adjustable cinching action that tensions the straps to the desired degree. The preferred embodiment also includes a brightly colored or phosphorescent name display which is exposed or backlighted when the shoe is tightened onto the foot, and a sound transducer which emits a sound as the straps are tightened by the retractor.

DESCRIPTION OF THE PREFERRED EMBODIMENT

The directional terms, e.g. "rear", "back", "front", "forward" and derivatives thereof, as used herein to describe and claim the invention are merely relative to an arbitrarily chosen reference direction which in this case was chosen to match the directional reference ordinarily used when describing a foot. For example, toes are ordinarily described as being at the "front" of a foot and a heel as being at the "rear" or "back" of the foot.

The terms do not indicate, nor should they be interpreted to indicate, any absolute or necessary directional reference.

Figure 1:
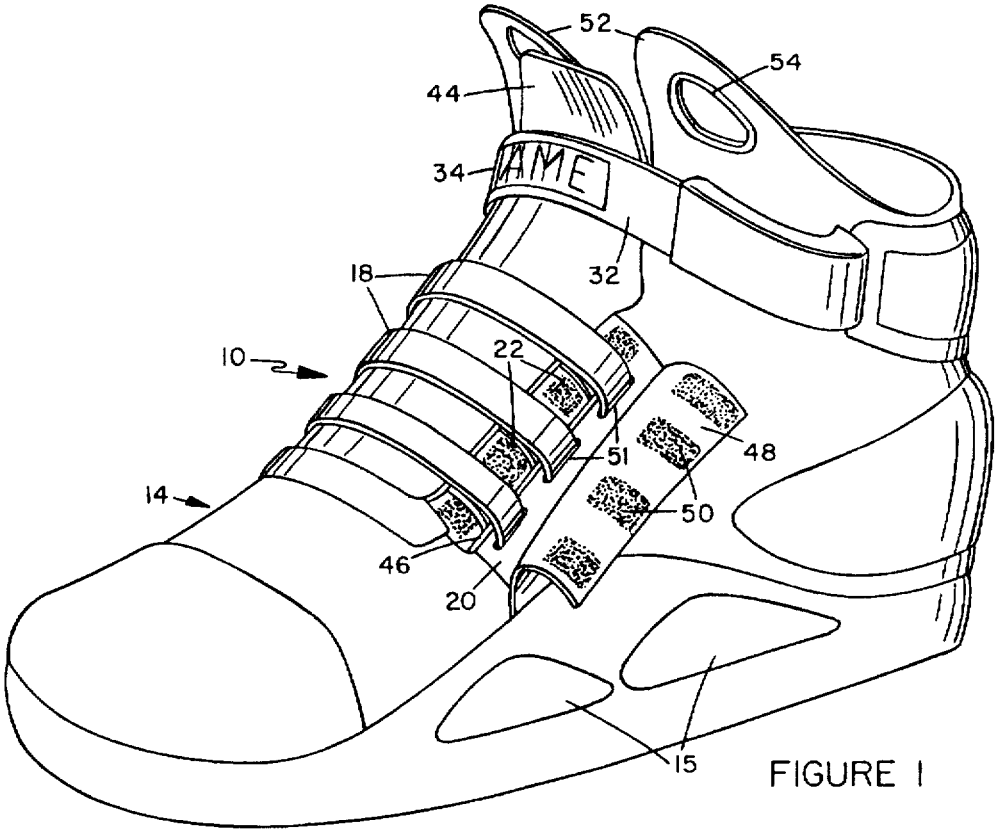
FIG. 1 is a perspective view of a shoe according to this invention as it appears in use on a foot.
Figure 2:
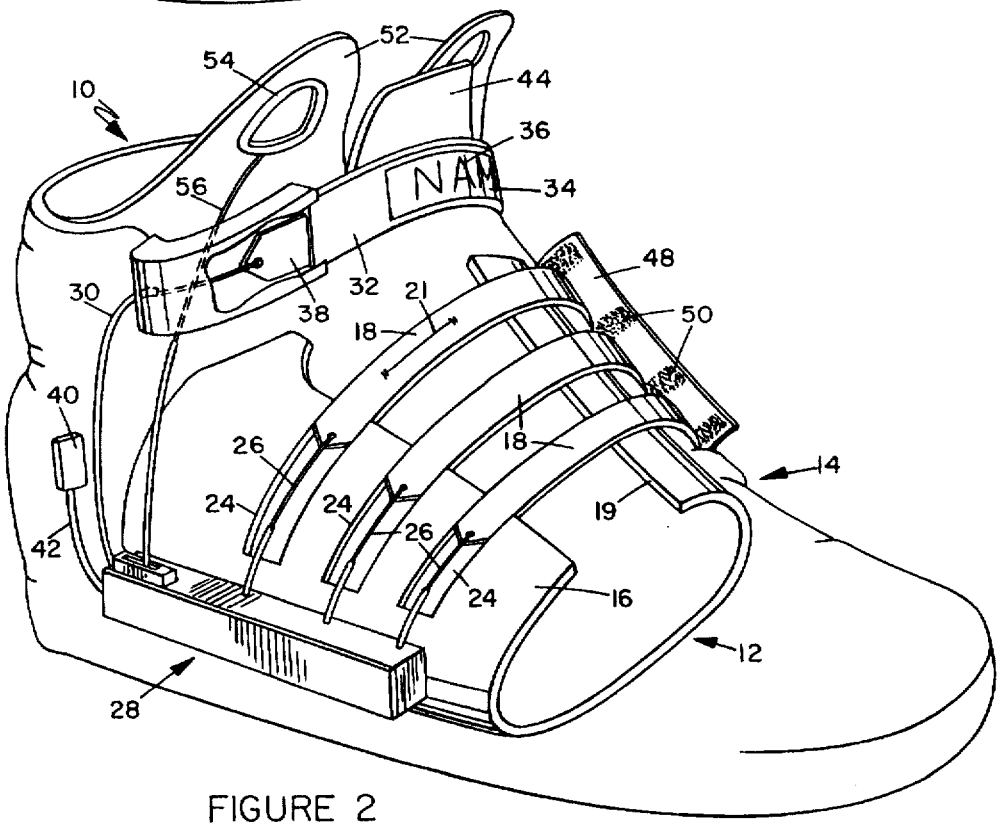
FIG. 2 is a perspective view similar to FIG. 1 with the shoe straps in a relaxed state, i.e. straps loosened, with portions cut away to show an inner casing of the shoe body.

Referring to FIGS. 1 and 2, a shoe according to this invention is illustrated to have a body 10 comprised of three major parts: a casing 12 which is a boot-like inner member, a retractor mechanism 28, and an outer cover 14. The outer cover is more than just an overlay of cloth, leather, or some other material, but incorporates a heel, sole, sides and top portions of the shoe which define the qualities of flexure, support, and gripping capacity that are inherent in quality shoes. Phosphorescent-colored side panels 15 and other aesthetic features may be incorporated into the outer cover. The casing 12 is made of a tough, but largely flexible sheet 16 which can extend around the heel, lower ankle, and the lower portion of the foot leaving an opening at the instep. The casing can be an inner liner of an outer cover. The casing is best illustrated in FIG. 2, except that the heel and toe covering portions have been cut away. The retractor 28 as illustrated is mounted laterally on the outside of the inner casing but disposed inside the outer cover.

Referring again to FIGS. 1 and 2, a plurality of cinch straps 18, which in the illustrated embodiment are three in number, extend across an instep opening 19 defined by the inner casing and are connected at both ends to the inner casing. The upper most strap incorporates a reinforced slit 21 which allows it to be more easily grasped by the wearer. At common ends the straps pass through respective retainer slits 51 defined in the inner casing. As illustrated, the retainer slits are disposed along a side of the inner casing's instep opening, the side that is remote from the retractor 28. In the preferred embodiment the ends of the straps extending through the retainer slits loop back to adhere to themselves with hook-and-loop fastener material (Velcro™), e.g. at the regions 22 of FIG. 1. A person can adjust the length of the straps to accommodate his or her particular foot by varying the overlap at the retainer slits end of each strap. Once adjusted, a flap 48 with hook and loop patches 50 is secured by the exposed hook and loop material 22 which cosmetically covers the retainer slits and further secures the straps at their adjustable length. The other ends of the straps fit slidingly into respective recessed tracks 24 defined by the inner casing and are attached to respective cables 26.

As will be further explained, the retractor 28 has two stable states: a charged state and an uncharged state. In the charged state the retractor relaxes the cinch straps allowing them to be loose for insertion or removal of a foot. In the uncharged state, the retractor forces the cinch straps to be tight about the foot, as illustrated in FIG. 1. When the retractor is discharging, i.e., changing from the charged state to the uncharged state it retracts, i.e., pulls the straps, via their respective cables, along their respective tracks 24 toward the retractor, tightening the straps and cinching the shoe to the foot.

Referring again to FIGS. 1 and 2, an upper strap push-pull cable-in-tube 30 is pulled along with the lower straps' cables 26 when the retractor is released to assume its uncharged state. The upper strap cable-in-tube connects to an end of an upper strap as a flat sleeve 32 crossing the outer cover's instep gap high on the shoe. The flat sleeve terminates in a display window 34, generally facing the toe of the shoe, that is transparent except for a display 36 imprinted on the window. For illustrative purposes, the lettering may be assumed to be dark colored. Extending slidingly through the flat sleeve is a semi-rigid strip 38 that provides a background for the display window. The background strip 38 preferably has a black or dark segment and a phosphorescent, glow-in-the-dark segment. When the retractor tightens the straps, the sleeve is moved in relation to the strip such that the phosphorescent segment is exposed behind the window to brilliantly backlight the display 36. When the retractor is in its charged state, the dark segment of the strip is behind the window leaving the display still visible but obscure. In this way the shoe has what amounts to a masked mode and an unmasked mode. The visual display 36 can, for example, comprise the name of the shoe manufacturer, or the model name of the shoe which could include the logotype of the company or model.

Another optional feature of the shoe is a device 40 for producing a sound, for example, when the cinch straps are tightened. The device can be mounted in a bulbous portion of the shoe cover 14, e.g. as is shown in FIG. 2. The device incorporates an audio microcircuit and sound transducer which can be a piezo transducer. The device produces a sound as the straps are tightened, such as a slipping or sliding sound which terminates abruptly as the straps cinch down into their final positions. Preferably the device is battery-operated with the battery incorporated into the bulbous portion or some other convenient part of the shoe. The device 40 is connected by wires 42 to a limit switch sensor described below.

Figure 7:
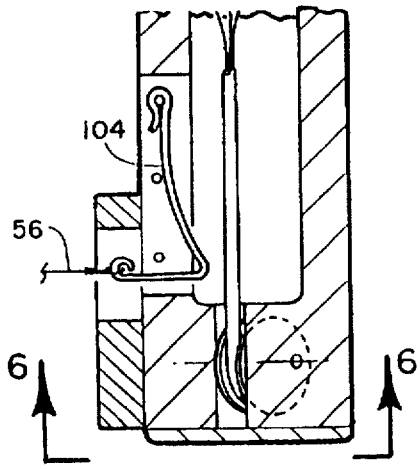
FIG. 7 is a longitudinal horizontal section taken through a catch portion of the first embodiment retractor.

Referring again to FIGS. 1 and 2, the cover 14 of the shoe includes a tongue 44 and an instep opening 46 defined by the cover but more specifically by a cover side flap 48. On its inside surface the side flap has Velcro™ patches 20 which fit interstitially between the lower cinch straps and attach to a portion of the cover, so that ends of the lower straps 18 remote from the retractor are covered. On the other side of the instep opening 46 three openings exist between the outer cover and inner lining allowing the straps to retract into their respective cavity tracks. The cover 14 extends upward to define forwardly and upwardly projecting lobes 52 in the illustrated embodiment. One of the lobes incorporates a fingergrip, such as a ring 54, which is linked to a catch inside the retractor 28 by means of a ring cable 56. The catch 104 is best illustrated in FIG. 7. The ring is pulled by the user to release the retractor to pull the straps tightly against the user's foot in the shoe.

Figure 3:
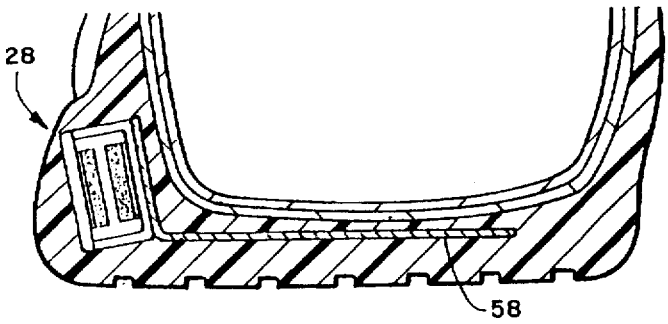
FIG. 3 is a transverse section taken through the shoe casing illustrating the relationship between a retractor and its reinforcing plate.

Turning now to the retractor 28, FIG. 3 illustrates a reinforcing plate 58 affixed to the retractor to stabilize it. This plate may be an integral part of the sole, or embedded in or affixed to the casing. Its function is to distribute the stresses experienced by the retractor, stresses that will be significant as the cinch straps are repeatedly tensioned and released.

Figure 9:
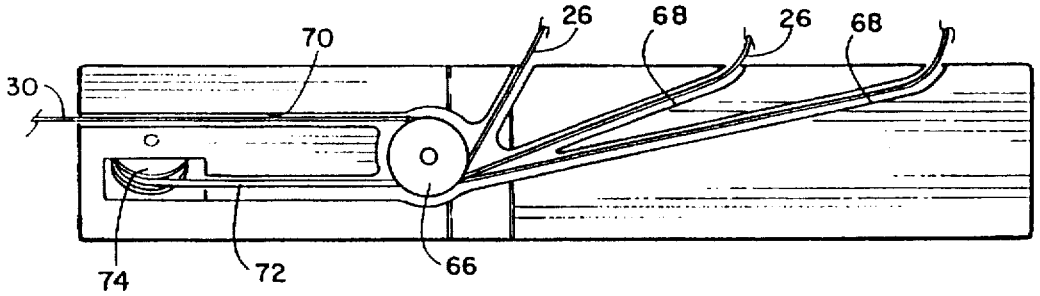
FIG. 9 is a rear plan view of the inside surface of an outer housing part of a first embodiment retractor for a left shoe, the other views are of a right shoe retractor.

Referring to FIGS. 4–11, a first embodiment of the retractor 28 includes a cable routing housing having an inner part 62 and an outer part 64, with the two parts fitting together to form the housing. The inner and outer parts journal a cable distribution pulley 66 disposed in a pulley chamber defined by the interface. The outer part defines a pulley slot 76 in which a direction-reversing pulley 74 having an axle 78 is disposed, the axle being journaled in the walls of the slot. The axis of the direction-reversing pulley is angled from the axis of the cable distribution pulley. The interface also defines respective upwardly directed passageways 68 for the lower strap cables 26 and two rearwardly directed passageways one 70 for the upper strap cable in tube 30 and the other 72 for cable communication between the cable distribution pulley and the direction-reversing pulley. As best illustrated in FIG. 9, the passageways are such that as the strap cables, 26 and 30, enter their respective passageways, they are directed by the passageways to converge upon the cable distribution pulley where the strap cables are gathered into a cable bunch and redirects rearward to the direction-reversing pulley. The pulley slot 76 is open to a corridor 80, defined in the side of the outer part opposite the interface, in which a tensioning mechanism is disposed. The direction-reversing pulley reverses the direction of the cable bunch and angularly shifts the reverse-directed bunch into the corridor where it is connected to the tensioning mechanism.

Referring again to FIGS. 4–11, the tensioning mechanism basically has two elastic subsystems. The corridor 80 has a rear end 83 and a forward end 82. Disposed lengthwise in the corridor are a stiff elastic member 84 and a long elastic member 86, members of a first subsystem and a second subsystem respectively. In this embodiment the elastic members are elongated bars of elastic material, such as a rubber or rubber-like substance. Forward ends of the elastic members are anchored at the corridor's forward end by any convenient means, such as an H-shaped mounting block 88 to which the elastic members are bonded and which in turn is affixed to the walls of the corridor, best shown in FIG. 11. The first elastic subsystem also includes a carriage 90 which is affixed to a free (unanchored) end of the stiff elastic member 84. As will be explained below, in operation the carriage is forced to slide rearwardly along the corridor but only to a limited extent defined by a shoulder in the corridor that blocks further rearward movement of the carriage. The carriage has a rearwardly extended platform 92 providing a smooth sliding surface for a slide 94 of the second elastic subsystem. Projecting normally from opposite side margins of the carriage's platform are a pair of rear tabs 96. As the carriage travels near its rearward limit, the rear tabs encounter a pair of spring arms 98 projecting into the corridor from opposite corridor walls. Continued travel of the carriage causes the stiff rear tabs to bend the spring arms from the corridor, but once the rear tabs are past the spring arms, the spring arms snap back into their original positions, catching the forward edges of the rear tabs and thereby capturing the carriage in the position best illustrated in FIG. 5. The spring arms and tabs together comprise a capturing mechanism.

Figure 4:
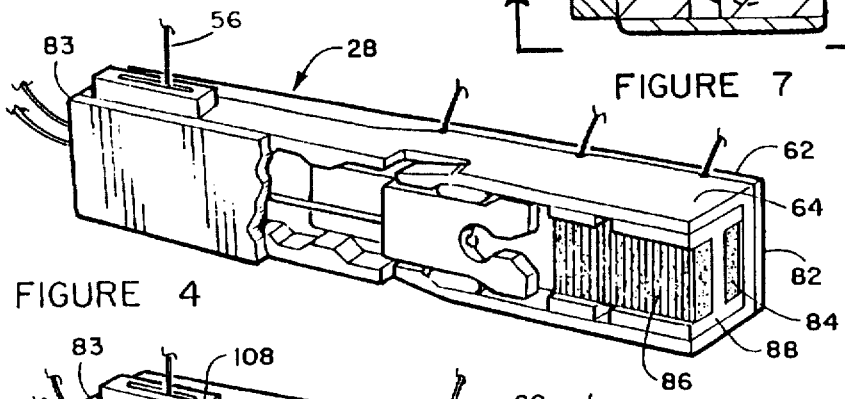
FIG. 4 is a perspective view of a first embodiment of the retractor with an outer cover removed in part.
Figure 5:
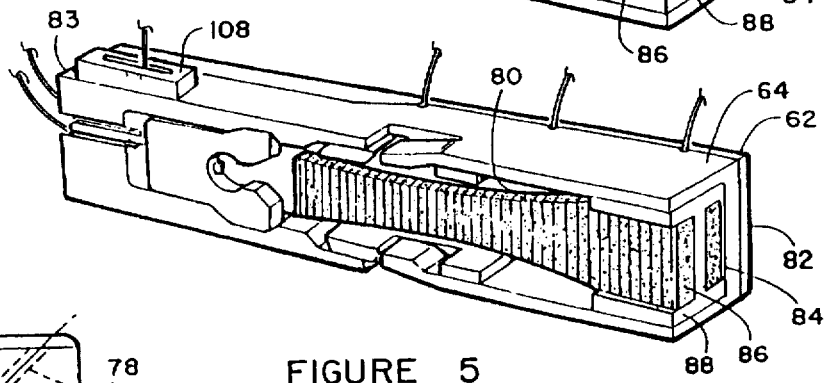
FIG. 5 is a view of the first embodiment retractor similar to FIG. 4, but with the cover completely removed and with the retractor in its charged state.
Figure 6:
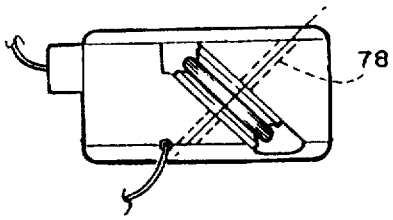
FIG. 6 is a view taken along line 6—6 of FIG. 7.
Figure 8:
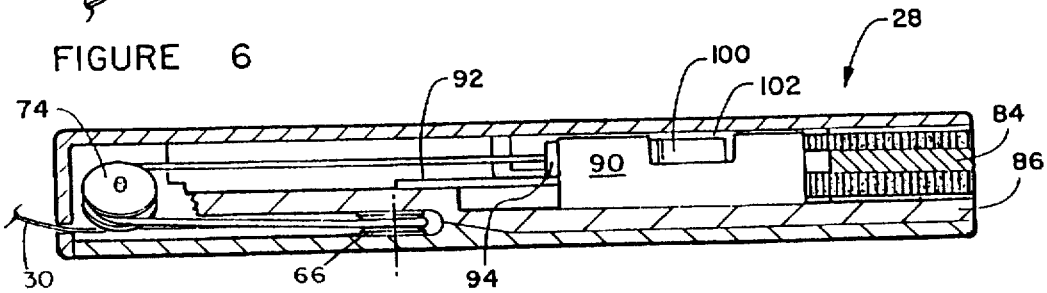
FIG. 8 is a sectional view taken longitudinally through the first embodiment retractor.
Figure 10:
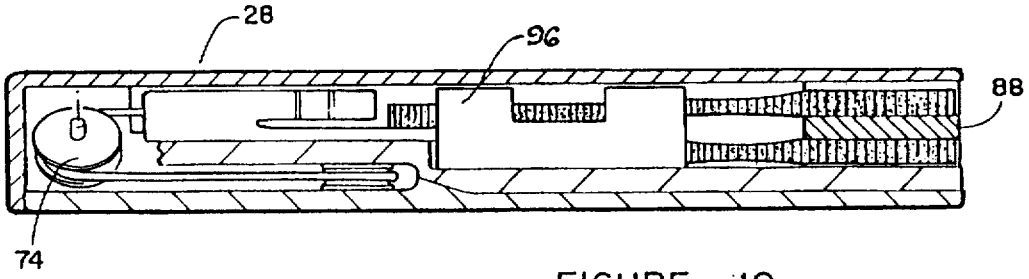
FIG. 10 is a section similar to that of FIG. 8, but illustrating the first embodiment retractor in its charged state.

Referring again to FIGS. 4–11, the retractor is changed from its uncharged state to its charged state by pulling on one of the straps, preferably the upper of the three lower straps 18. This action pulls on one of the cables 26, namely the cable connected to the upper of the lower straps. The bunched cables, 30 and 26, wrap around the direction-reversing pulley 74 and are connected to the slide 94 at the slide's rear end. The front end of the slide is affixed to the free end of the long elastic member 86. The pull on the cable of the upper of the lower three straps forces the slide to move rearward in the corridor stretching the long elastic member. The carriage 90 is pulled along the corridor by the slide but only to the carriage's limit of travel (the point at which it is caught by the spring arms 98). The slide pulls the carriage by means of a pair of outwardly extended, oppositely directed ears 100 disposed intermediate the slide's ends. When the retractor is in its uncharged state, the slide's ears engage in respective gaps 102 just in front of the tabs 96 of the carriage, as best illustrated in FIG. 4. As the slide moves rearward its ears catch the carriage's tabs 96 to pull the carriage along with the slide until the carriage reaches its limit of travel. As the slide and carriage are pulled rearward by the pull on the upper of the lower three straps, toward the position shown in FIG. 5, the corridor's spring arms 98 snap into the carriage gaps 102. The ears are beveled and the forward edge of the carriage tabs 96 are beveled so that as the slide continues its rearward travel beyond the travel limit of the carriage, the ears, which are biased outwardly and resilient, compress inwardly and slide between the now stationary tabs of the carriage due to the inward force of the spring arms and the pull on the cable connected to the upper of the lower straps 26. Once the slide reaches the rear end of the corridor, a wire catch 104, such as detailed in FIG. 7, snaps into a catch slot 106 defined by the slide at its top. The elastic members are thus held in their extended, i.e., charged states by the catch and the retractor is then said to be in its charged state, as best illustrated in FIGS. 5 and 10. The retractor will remain charged until the wire catch is pulled from the catch slot.

When charging the retractor the high-tension of the stiff elastic member 84 is experienced only until the carriage arrives midway along the corridor 80, subsequent to which the slide continues against the tension only of the long elastic member 86.

Referring again to FIGS. 4–11, the catch 104 is mounted in a small, slotted catch housing 108, through which the ring cable 56 extends to attach to a free end of the catch. The other end is affixed to the outer part 64. As illustrated the catch is resilient and biased in the direction of the catch slot. To tighten the cinch straps, the fingergrip 54 is pulled. This pull is transferred to the catch via the ring cable and the catch is thereby bent upward releasing the slide. Once the slide is released when discharging the retractor, the slide snaps forward under the tension of the long elastic member 86. The ears compressed by the corridor's side walls slide between the carriage tabs 96 to between the corridor's spring arm detents 98. The ears then expand and push the spring arms sufficiently from the corridor to release the rear tabs 96 of the carriage, permitting the carriage with the slide riding in its center to return to the initial position together, as shown in FIG. 4.

Figure 11:
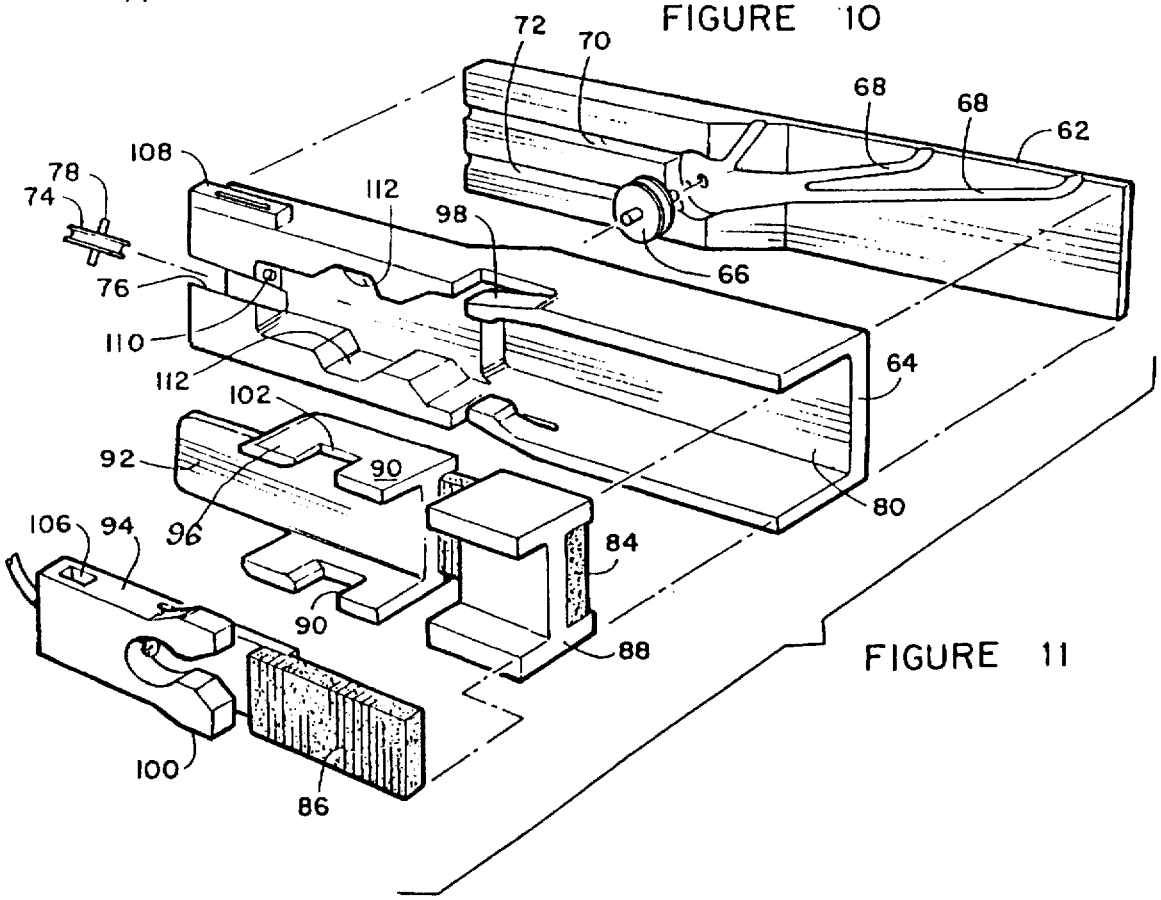
FIG. 11 is an exploded perspective view of the first embodiment retractor.

Referring to FIG. 11, a small limit switch 110 is disposed at the rear end of the corridor 80. The switch is actuated and held closed by the slide when the retractor is in its charged state. When the slide is released, the switch is released causing the sound transducer 40 to emit a sound.

Referring again to FIGS. 5 and 11, concavities 112 defined in the side walls of the corridor allow the ears 100 of the slide to expand into their relaxed position when the retractor is charged so that the ears are not constantly distorted, losing their spring tension quality.

Figure 12:
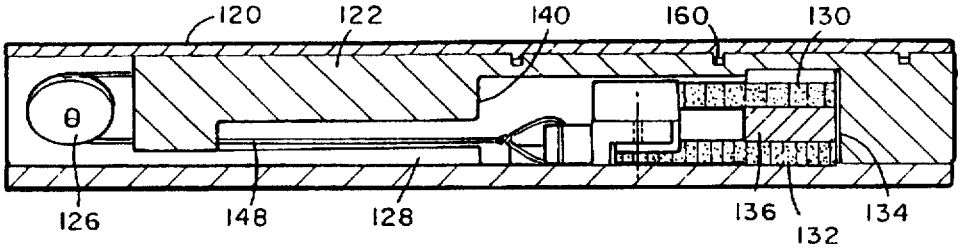
FIG. 12 is a sectional view taken along line 12—12 of FIG. 13.
Figure 13:
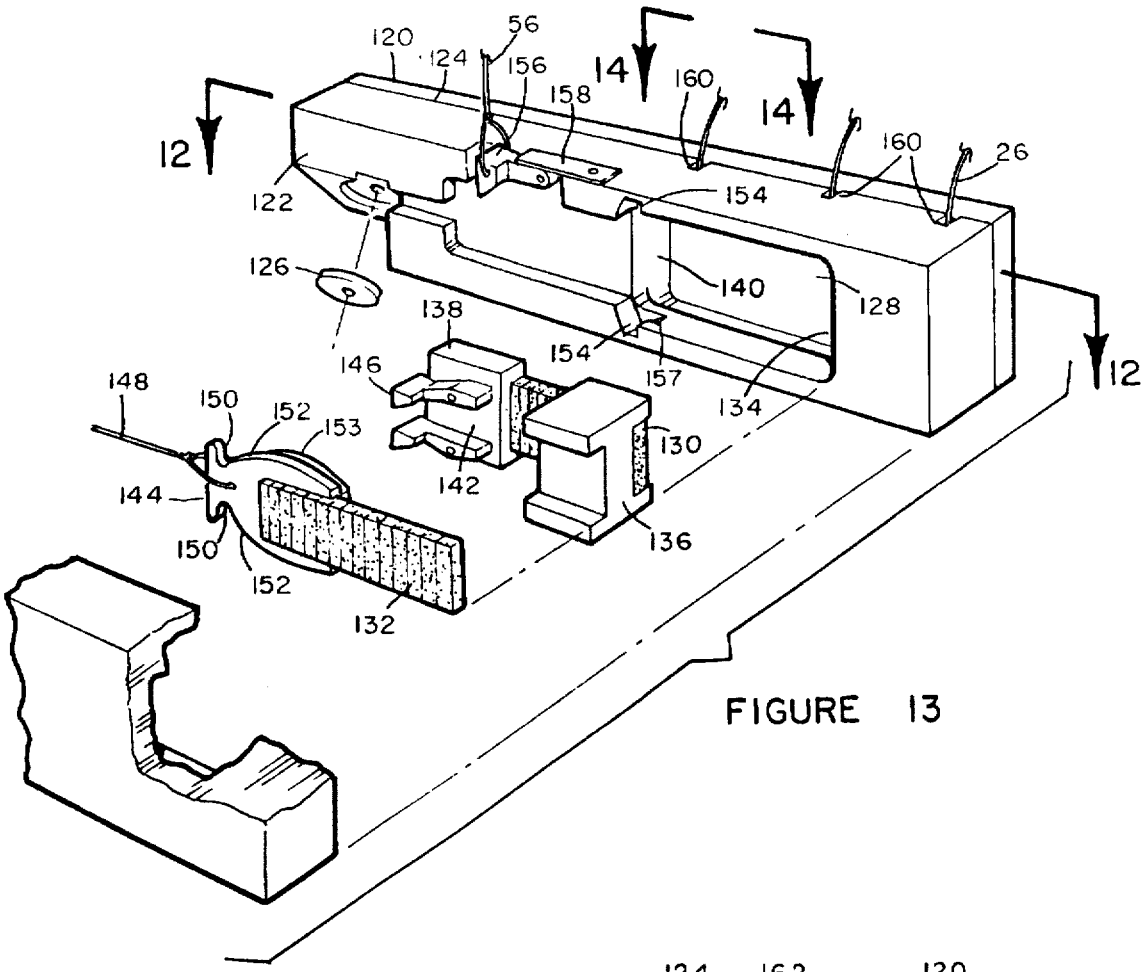
FIG. 13 is an exploded perspective view of a second embodiment of the retractor.

Referring to FIGS. 12 and 13, a second embodiment of the retractor is illustrated to also include a cable routing housing having an inner part 120 and an outer part 122, with the two parts fitting together along an interface 124 to form the housing. This embodiment has an inner curved distribution surface (not shown) which replaces the cable distribution pulley of the first embodiment. The passageway is in cable communication with a direction-reversing pulley 126 journaled in the outer part, and a network of strap cable passageways 160 converging on the curved distribution surfaces. On a side opposite the interface, the outer part 122 defines an elongated corridor 128 in which a second embodiment tensioning mechanism is disposed. As in the first embodiment, the direction-reversing pulley reverses the direction of a strap cable bunch and angularly shifts the reverse-directed bunch into the corridor which it is connected to the tensioning mechanism. As in the first embodiment, the tensioning mechanism has two elastic subsystems. Disposed lengthwise in the corridor are a stiff elastic member 130 and a long elastic member 132, members of a first subsystem and a second subsystem respectively. In this embodiment the elastic members are elongated bars of elastic material, such as a rubber or rubber-like substance. Forward ends of the elastic members are anchored at the corridor's forward end 134 to an H-shaped mounting block 136 to which the elastic members are bonded and which in turn is captured between the walls of the corridor, as is best shown in FIG. 12. The first elastic subsystem also includes a carriage 138 which is affixed to the free (unanchored) end of the stiff elastic member 130. With force sufficient to stretch the stiff elastic member, the carriage can be made to slide rearwardly along the corridor but only to a limited extent defined by a shoulder 140 in the corridor that blocks further rearward movement of the carriage. The carriage has a platform 142 providing a smooth sliding surface for a slide 144 of the second elastic subsystem. Mounted on the platform are a pair of bidirectional latches 146. The latches are mounted so that they can pivot parallel to one another on the platform. At one end the slide 144 is affixed to a free (unanchored) end of the long elastic member 132, and at the other end the slide is connected to the strap cable bunch 148 emanating from the direction-reversing pulley 126. The slide has opposing lateral indentations 150 at its rear end and lateral convex cam surfaces 152 and 153 upon which the carriage's latches 146 ride.

Referring again to FIGS. 12 and 13, the retractor has a charged state and an uncharged state which function to loosen and tighten, respectively, the straps 18 as in the first embodiment. In the uncharged state the slide is disposed against the carriage and the carriage latches protrude into the slide's lateral indentations, the latches being confined therein by the corridor walls. When the retractor is being charged, the slide is pulled rearward in the corridor by force transmitted from the upper of the three lower straps 26. Initially the carriage is pulled along by the slide because the carriage's latches protrude into the slide's lateral indentations. The carriage continues to be pulled along until it reaches its limit of travel. At the limit of travel where the carriage engages the shoulder 140 the corridor's walls flare to define recesses 157. As the slide continues its rearward travel beyond the carriage's limit, the cam surfaces 152 on the slide cause the carriage's latches 146 to rotate outwardly from protruding into the slide's lateral indentations 150 to protruding into the corridor walls'recesses such as exemplary recess 157 and detent locking openings 154. When the detents are forced in the locking openings, they hold the carriage at its limit of travel until it is subsequently released. The cam surfaces 152, latches 146 and locking openings 157 together comprise a capturing mechanism. When the slide is near the rear end of the corridor 128 it pushes a biased pivoting catch 156 out of the way. When the slide reaches the rear end of the corridor, the catch 156 snaps into one of the slide's lateral indentations 150 to hold the slide in place. The catch 156 is biased by a leaf spring 158 to protrude into the path of the slide. The elastic members are thus held in their extended, i.e., charged states and the retractor is then said to be in its charged state. The retractor will remain in its charged state until the catch is pulled from the slide's indentation by the ring cable 56. When the catch is pulled, the slide is snapped forward by the long elastic member. During its return travel, the slide's cam surfaces 153 cause the carriage's detents to rotate back into the slide's lateral indentations thereby releasing the carriage. This allows both elastic members to contract tightening the straps.

Figure 14:
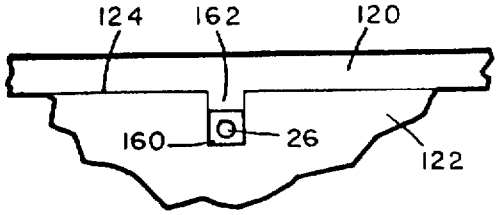
FIG. 14 is a partial plan view of the second embodiment retractor showing in detail a strap cable orifice.

Referring to FIGS. 12–14, the passageways 160 for the lower straps'cables 26 defined at the interface 124 of the cable routing housing can include respective tongues 162 projecting from the inner housing part 120 into the passageways. The tongues effectively offset the inner walls of the passageways from the seam of the interface. This prevents the cables from working or wearing themselves into the interface seam and eventually becoming lodged in the seam.

The second embodiment of the retractor can also include a switch, such as the limit switch 110 (FIG. 11) of the first embodiment, and a sound transducer controlled by the switch.

The dual elastic subsystems of both retractor embodiments work very effectively. Ordinarily, when an elastic member is stretched out to near its maximum length the elastic member's tension, i.e., charge is the greatest, and as it contracts, the tension becomes less. A retractor according to this invention, however, has a two-stage elastic member construction in that it has two elastic members which are sequentially discharged in two stages to tighten the straps. One member is discharged to initially tighten the straps but the release of the other member is delayed to provide a power boost at a time when the charge in the long member is significantly diminished. In the disclosed embodiments a stiff elastic member is released for the terminal portion of the retractor discharge and a relatively weaker, longer elastic member is used for the first portion of the discharge so that the high-energy power stroke of the combined elastic bars occurs after the principal strap tightening stroke of the long elastic member alone. As an example of the relative elasticities of the elastic bars, a size nine shoe with three lower straps can have a "long" bar which exerts about 20 lbs. of tension when fully charged and a "stiff" bar which exerts 20–25 lbs. of tension when fully charged. When the straps are fully retracted, the bars together still exert 10–15 lbs. of tension to keep the straps taut.

The principal parts of a retractor, according to this invention, are injection moldable and therefore inexpensive to mass produce, so that a sophisticated elastic action is achieved at a cost which is minimal in quantity production.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

We claim:

1. A self-tightening shoe comprising:

i) a casing to accommodate at least a portion of a foot of a wearer;

ii) at least one strap, responsive to tensile force applied thereto, for cinching the casing to a foot disposed in the casing; and iii) a retractor, mounted on said casing and connected to said at least one strap, adapted to apply tensile force to said strap, the retractor comprising:

a) an elastic element connected to the retractor, said elastic element being connected to said strap, b) a charging mechanism operable by the wearer to tension said elastic element, c) a catch for releasably holding said elastic element in a stretched condition, said strap being freed from the tensile force to allow insertion and removal of a foot whenever the elastic element is held in the stretched condition, and d) a release to selectively disengage the catch, a release of the catch allowing the elastic element to discharge and apply the tensile force to said strap.

2. The shoe according to claim 1 wherein the elastic element is charged by the wearer pulling on said strap in opposition to the tensile force of the elastic member.

3. The shoe according to claim 1 wherein the elastic element comprises dual elastic members cooperating to tension said strap, the elastic members being releasable sequentially for discharge.

4. The shoe according to claim 1 wherein said retractor further comprises a fingergrip for being gripped and pulled, means for operatively linking the catch to the fingergrip the catch being released by pulling on the fingergrip.

5. The shoe according to claim 4 wherein the fingergrip comprises a ring defined by an upper flap of a shoe cover.

6. The shoe according to claim 1 wherein the elastic element comprises at least one member having the elastic characteristics of a rubber material.

7. The shoe according to claim 1 wherein the retractor further comprises:

a) a dual elastic system including a stiff elastic member and a long elastic member operating in parallel;

b) a housing defining an elongated corridor having a first end at which respective first ends of the stiff and long elastic members are affixed, and a second end;

c) a carriage, slidable in said corridor and connected to a free end of said stiff elastic member, mounted for movement along said corridor to stretch the stiff elastic member;

d) a capturing mechanism for capturing and holding said carriage at a position intermediate the ends of said corridor;

e) a slide connected to a free end of the long elastic member and attached to said strap when the charging mechanism is operated by the user to stretch the long elastic member by movement along the corridor to the corridor's second end;

f) initial movement of said slide causing the carriage to move along therewith to the intermediate position where the carriage is held by the capturing mechanism during operation of the charging mechanism, the slide subsequently releasing the carriage from the intermediate position when the catch is released.

8. The shoe according to claim 7 further comprising:

a) a pair of bi-directional latches pivotally affixed to the carriage means;

b) a corresponding pair of indentations defined by the housing in the corridor at said intermediate position;

c) a pair of cam surfaces on said slide upon which the latches ride when the slide moves in relation to the carriage; and d) a shoulder for stopping the carriage at the intermediate position, the cam surfaces causing the latches to pivot into respective locking indentations whenever the carriage is stopped by the shoulder, the slide continuing to move with continued tension on the cables, the latches being adapted to capture the carriage until they are pivoted out of the indentations by the cam surfaces when the slide is moving in the reverse direction.

9. The shoe according to claim 8 further comprising a pair of locking openings defined by the slide and disposed to receive the bi-directional latches, the corridor walls constraining the latches to be parallel to one another, except at the intermediate position.

10. The shoe according to claim 7 wherein said capturing mechanism comprises two detents affixed to the housing and biased to project into the corridor and two corresponding detent gaps defined by the carriage, the carriage deflecting the detents as it passes thereby in said corridor, each gap being alignable with its corresponding detent to capture the carriage.

11. The shoe according to claim 10 wherein said slide further comprises a pair of ears which engage into the gaps defined in the carriage to connect the slide to said carriage, the ears being drawn out of the gaps when the carriage is captured at the intermediate position to disconnect the slide from the carriage.

12. The shoe according to claim 1 wherein the strap comprises a plurality of strap members, and wherein the retractor further comprises:

a) a corresponding plurality of cables extending out from the retractor connecting the retractor to the strap members;

b) a cable distribution housing defining a corresponding plurality of cable passageways; and i) a distribution pulley, mounted in said housing, for mechanical advantage and distribution of the cables, the cables being bunched together in the distribution pulley but diverging from one end of the pulley into respective passageways to connect to respective strap members, the bunched cables extending from the other end of the pulley from that connected to said slide.

13. The shoe according to claim 1 further comprising a display, a means for backlighting the display, and a means for operatively connecting the means for backlighting the display to the retractor, the display being backlighted whenever the elastic element is in an unstretched condition and not backlighted whenever the elastic element is in a stretched condition.

14. The shoe according to claim 1 further comprising:

a) a sound transducer affixed to the casing for producing sound when actuated; and b) a switch for actuating the sound means whenever the retractor means is released from its charged state.

15. The shoe according to claim 1 wherein said at least one strap comprises a plurality of strap members, one end of each strap being connected to said retractor and the other end being length-adjustably connected to the casing.

16. The shoe according to claim 1 further comprising reinforcing means, affixed to the shoe, for stabilizing the retractor means.

17. The shoe of claim 1 wherein said shoe has an instep opening, and wherein said shoe further comprises an additional strap member at the instep opening of said shoe connected to said retractor through a cable means for transferring force from said retractor to said additional strap member.

18. A self-tightening shoe comprising;

a casing for at least partially enclosing a foot;

a strap for cinching said casing onto a wearer's foot disposed therein;

an elastic mechanism comprising at least two elastic elements each having a free end and an anchored end;

a charging mechanism connected to said strap for transferring some of the energy expended by the wearer in loosening said strap to store energy in said elastic elements by movement of a free end of said elastic element relative to said anchored end;

at least a first said elastic element being limited to movement only through an intermediate distance and being releasably captured at said intermediate distance;

at least a second of said elastic elements moving past said intermediate distance to be held at a limit distance by a releasable catch and upon release of said catch and return movement to said intermediate distance causing said first element to be released from said capture mechanism and to add additional stored energy to the final cinching of said casing by said strap.

* * * * *